United States Patent [19]

Lindsay

[11] 4,206,327

[45] Jun. 3, 1980

[54] SWITCHING ARRANGEMENTS

[76] Inventor: Herbert L. Lindsay, 106, Elstree Rd., Bushey Heath, Hertfordshire, England

[21] Appl. No.: 842,266

[22] Filed: Oct. 14, 1977

[30] Foreign Application Priority Data

Oct. 14, 1976 [GB] United Kingdom ..... 42793/76

[51] Int. Cl.[2] ..... H01H 43/00

[52] U.S. Cl. ..... 200/33 R; 368/52; 368/147

[58] Field of Search ..... 200/33 R, 35 W, 161, 200/237–251; 58/46 R, 48, 33, 28

[56] References Cited

U.S. PATENT DOCUMENTS

| | | | |
|---|---|---|---|
| 1,083,486 | 1/1914 | Granoux | 200/35 W X |
| 2,674,664 | 4/1954 | Clubb et al. | 200/33 R |
| 3,258,086 | 6/1966 | Romo | 58/46 R X |
| 3,819,885 | 6/1974 | Moroto et al. | 200/33 R X |
| 3,820,432 | 6/1974 | Fishbein | 58/48 X |
| 3,846,599 | 11/1974 | Fontaine | 200/161 X |

*Primary Examiner*—James R. Scott

*Attorney, Agent, or Firm*—Whittemore, Hulbert & Belknap

[57] ABSTRACT

A switching arrangement comprises a spring-loaded clockwork movement and a switch to control a device, the movement of the spring itself, as it is tensioned or becomes substantially de-tensioned, being utilized to operate the switch.

8 Claims, 4 Drawing Figures

SWITCHING ARRANGEMENTS

BACKGROUND OF THE INVENTION

1. Field of the Invention

This invention relates to a switching arrangement comprising a spring-loaded clockwork movement and a switch to control a device.

2. Description of the Prior Art

Spring-loaded clockwork movements are known which have means to operate switches by means of tabs, for example; in such a known clockwork movement, these tabs rotate, as the spring unwinds, in the manner of the hands of a clock face, so that the tabs come into contact with a part of a switch to operate it.

It is an object of the present invention to utilise the movement of the spring itself in a spring-loaded clockwork movement to operate a switch.

According to the present invention, there is provided a switching arrangement comprising a spring-loaded clockwork movement and a switch to control a device, the switch being directly actuable by the spring in said movement and the actuation of said switch being dependent upon the state of tension of said spring, which thereby controls the period of operation of the device.

BRIEF DESCRIPTION OF THE DRAWINGS

For a better understanding of the invention and to show how the same may be carried into effect, reference will now be made, by way of example, to the accompanying drawings, in which.

DESCRIPTION OF THE PREFERRED EMBODIMENT

Figure 1:
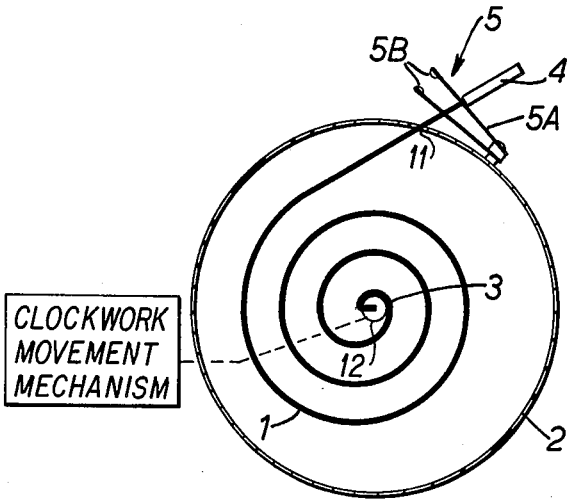
FIG. 1 is a schematic plan view of one form of a spring-actuated electrical switch, the spring being in an unwound or de-tensioned state.
Figure 2:
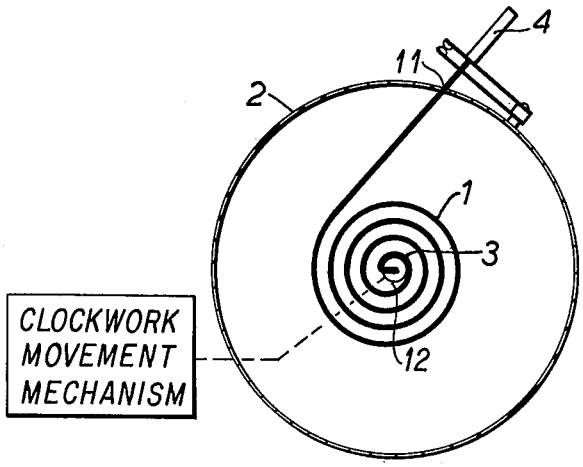
FIG. 2 is a view similar to FIG. 1 but showing the spring in a wound or tensioned state.

FIGS. 1 and 2 show a spiral spring 1 housed within a cylindrical housing 2 of a clockwork movement (not shown). The inner end 3 of the spring 1 is secured to a shaft 12 of a conventional winding or tensioning means of the clockwork movement, for example, a ratchet and key mechanism. The other end of the spring 1 (often referred to as the "fixed" end), in the example shown, extends through an aperture 11 in the wall of the housing 2, this end having a portion 4 which is of a greater dimension, for example, in width, than the width of the aperture in the housing 2, to prevent this end of the spring from being pulled into the housing 2 when the spring is being wound up or is tensioned.

In the example shown, a resiliently-biased electrical switch 5 is interposed between the end portion 4 of the spring 1 and the outer wall of the housing 2. The switch 5, in the example shown, includes a leaf spring assembly 5A, with its two arms electrically insulated from one another and carrying electrical contacts 5B which can contact each other upon compressing the two arms of the leaf spring assembly 5A together by tensioning of the spring 1.

In operation, it will be seen that the end portion 4 is restrained from moving into the housing 2 through its aperture upon winding-up or tensioning the spring. If the spring 1, when untensioned, has adopted the condition shown in FIG. 1, then, upon winding-up of the spring, the end portion 4 will tend to be drawn in the direction towards the aperture in the housing 2 and will thereby compress the two arms of the leaf spring assembly 5A together thereby causing the contacts 5B to contact one another as shown in FIG. 2.

Upon unwinding of the spring 1, the compressed leaf spring assembly 5A will encourage the end portion 4 of the spring 1 to move back to the position shown in FIG. 1 thereby breaking the electrical contacts 5B of the switch 5.

With the switch described above, it will be appreciated that, if a device has been activated by the two contacts 5B making contact and thereby completing a circuit upon winding-up of the spring 1, the length of time during which the device is switched on is dictated by the length of time that it takes for the spring to unwind so that it becomes substantially de-tensioned sufficiently for the compressive force of the leaf spring assembly 5A to overcome the tension in the spring 1 to break the electrical circuit. This switch is particularly applicable to clockwork motors, for example, in clockwork toys such as toy vehicles, where lights can be illuminated and extinguished. Also, the switch can be incorporated in a clockwork movement of a musical toy or box which, whilst playing a tune, can actuate the switch to cause an electrical light, which can be battery operated, to be activated for the same duration of time as the musical box plays or almost for the same time.

If a clockwork musical movment having the present switch were to be incorporated in a greetings card or a novelty, for example, then a part of the card or novelty could be illuminated for substantially the same period of time as the musical movement is playing. When the spring has completely or almost completely unwound, the illuminated part of the card or novelty will be switched off by the de-tensioned or substantially detensioned spring of the clockwork movement.

It will be appreciated that the present switch could cause any desired change in an electrical circuit or in a magnetically or a mechanically controlled device.

One of the electrical contacts 5B, instead of being mounted directly on one arm of the leaf spring assembly 5A, could be mounted on a part of the housing 2 or could be suitably fitted to a base, casing or frame or any other non-moving part of the clockwork movement.

Figure 3:
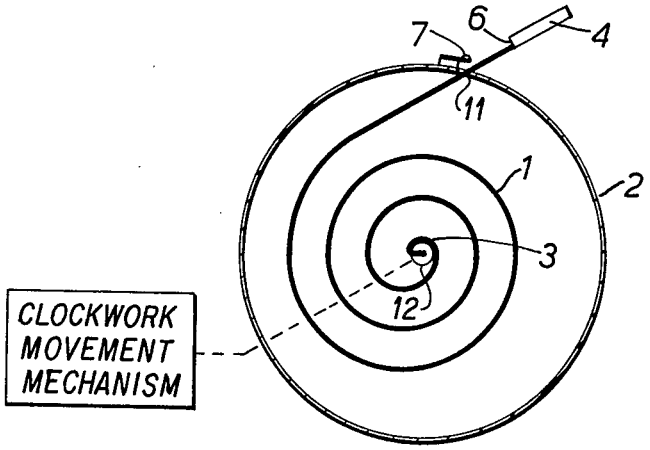
FIG. 3 is a schematic plan view of a second form of a spring-actuated electrical switch, with the spring in an unwound or de-tensioned state.

It has been found that a simpler form of switch, as shown in FIG. 3, is possible, since in some clockwork movements the spring 1 itself has a tendency to push the portion 4 out of contact with and away from the housing 2 as the spring becomes detensioned. Accordingly, there is no leaf spring assembly as in the first embodiment, the switch contacts being merely constituted by an electrical contact point 6 on the inner end of the portion 4 of the outer end of the spring 1 and an electrical contact point 7, insulated from the housing 2 and the spring 1, on the outer wall of the housing 2 adjacent the aperture through which the spring 1 passes. Suitable wires (not shown) lead from the contact points 6 and 7 to the device to be actuated. This arrangement is such that, when the portion 4 of the spring 1 is drawn in a direction towards the housing 2 by tensioning of the spring 1, the two electrical contact points 6 and 7 come into contact with one another to complete an electrical circuit. When the spring 1 becomes substantially de-tensioned, the circuit will be broken.

The clockwork movement itself need not be musical movement, but may be any kind of clockwork movement required to provide driving power to activate another device or other devices as well as the switch.

Figure 4:
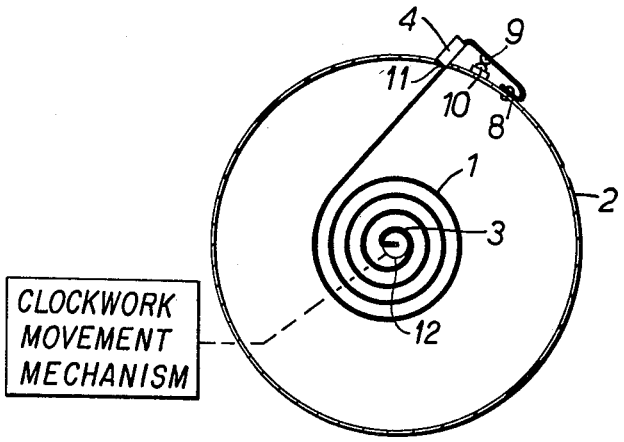
FIG. 4 is a schematic plan view of a third form of a spring actuated electrical switch, with the spring in a tensioned state.

Instead of the inner end of the portion 4 forming one of the contacts, it would be possible as shown in FIG. 4 to extend the portion 4 to form a loop with one of the contacts 9 inside it so that the tip 8 of the loop points towards the aperture in the housing 2. With the tip of the loop secured to the outer wall of the housing 2, the two contacts 9, 10 would face each other within the loop, the other contact 10 being on the housing 2. Alternatively, the tip of the loop could be free and point substantially perpendicularly towards the housing to form one of the contacts which thus faces the other contact on the housing 2.

An arrangement could be provided where the circuit is closed when the spring becomes substantially de-tensioned and is opened when the spring becomes tensioned.

It is envisaged that, instead of the outer end of the spiral spring 1 actuating the switch, it could be possible to arrange for the switch to be actuated by a part of the contracting and expanding bulk of the spiral spring within its housing 2 as it is being wound and as it unwinds, respectively.

It will be appreciated that, in the examples illustrated, the spring 1 is a spiral spring but any other type of spring of a clockwork movement can be provided to actuate the switch upon the spring becoming tensioned and substantially de-tensioned.

For example, a helical or coil spring could be used and in this case the action of tensioning or de-tensioning the spring itself would be linear, as opposed to action in a helical direction in the case of tensioning or de-tensioning a spiral spring.

I claim:

1. A switching arrangement comprising a spring loaded clockwork movement and a switch to control a device, the switch being directly actuable by the spring in said movement and the actuation of said switch being dependent upon the state of tension of said spring which thereby controls the period of operation of the device and including a housing for said spring, a winding or tensioning means to which the inner end of the spring is secured, an aperture in the wall of said housing through which the other end of the spring extends, said other end having a portion outside the housing, which portion is of a greater dimension than a corresponding dimension of the aperture in the housing to prevent said other end of the spring from being pulled into the housing when the spring is being wound up or is tensioned.

2. A switching arrangement as claimed in claim 1, wherein said switch is a resiliently-biased electrical switch which is interposed between said portion of said spring and the outer wall of said housing.

3. A switching arrangement as claimed in claim 2, wherein said resiliently-biased electrical switch includes a leaf spring assembly having two arms electrically insulated from one another and carrying electrical contacts which can contact each other upon compressing the two arms of the leaf spring assembly together by tensioning of the first mentioned spring.

4. A switching arrangement as claimed in claim 1, wherein said switch includes an electrical contact point on an inner end of said portion of said spring and an electrical contact point, insulated from said housing and said spring, on the outer wall of said housing adjacent said aperture, whereby when said portion of said spring is drawn in a direction towards said housing by tensioning of said spring, the two electrical contact points come into contact with one another to complete an electrical circuit.

5. A switching arrangement as claimed in claim 1, wherein said switch includes an electrical contact point which is insulated from said housing and said spring and which is on the outer wall of said housing adjacent said aperture, said portion of said spring being extended to form a loop with a further electrical contact point inside it so that the tip of the loop points towards said aperture and is secured to the outer wall of said housing, the two contacts facing each other within said loop, whereby when said portion of said spring is drawn in a direction towards said housing by tensioning of said spring, the two electrical contact points come into contact with one another to complete an electrical circuit.

6. A switching arrangement as claimed in claim 1, wherein said switch includes an electrical contact point which is insulated from said housing and said spring and which is on the outer wall of said housing adjacent said aperture, said portion of said spring being extended to form a loop which is free and points substantially perpendicularly towards the housing to form a further electrical contact point, whereby when said portion of said spring is drawn in a direction towards said housing by tensioning of said spring, the two electrical contact points come into contact with one another to complete an electrical circuit.

7. A switching arrangement as claimed in claim 1, wherein said spring is one of a spiral, helical and coil spring.

8. A switching arrangement as claimed in claim 1, wherein said device is present, said device being an electric light.

* * * * *